United States Patent [19]

Pisani

[11] 4,106,715

[45] Aug. 15, 1978

[54] ROLLING-UP MACHINE FOR LENGTHS OF CLOTH DESTINED FOR COLLAR-CUTTING MACHINES

[75] Inventor: Luigi Pisani, Cilavegna (Pavia), Italy

[73] Assignee: Officina Meccanica Pisani Luigi, Pavia, Italy

[21] Appl. No.: 775,473

[22] Filed: Mar. 8, 1977

[30] Foreign Application Priority Data

Mar. 22, 1976 [IT] Italy ..... 21416 A/76

[51] Int. Cl.[2] ..... B65H 25/26

[52] U.S. Cl. ..... 242/57.1; 226/20

[58] Field of Search ..... 242/57.1, 1, 5, 7; 226/15, 18, 19, 20

[56] References Cited

U.S. PATENT DOCUMENTS

| | | | |
|---|---|---|---|
| 2,871,013 | 1/1959 | Markey | 242/57.1 |
| 2,967,675 | 1/1961 | Markey | 242/57.1 |
| 3,232,547 | 2/1966 | Thiede | 242/57.1 |
| 3,759,457 | 9/1973 | Edes | 242/57.1 |
| 3,786,974 | 1/1974 | Kron | 226/19 |

*Primary Examiner*—Edward J. McCarthy

*Attorney, Agent, or Firm*—Stevens, Davis, Miller & Mosher

[57] ABSTRACT

A rolling-up machine for lengths of cloth destined for collar-cutting machines, comprising a rolling-up bar, motor to drive the bar, a cloth-drawing roll, motor to drive the roll, a mobile frame carrying fixed stretching bars and a bar carrying the cloth to be rolled up, the mobile frame being able to move transversally to the direction of unrolling of the cloth and continuously align the profile of one of the edges of the cloth roll corresponding to the head of the roll formed on the rolling-up bar, a cloth-stretching roll spaced from and parallel to the cloth-drawing roll and rotating in the same direction; a pair of idler bars seated below the stretching roll on the mobile frame; these idler rolls being pressed one against the other so as to press the cloth passing therethrough and cause a relative transverse sliding motion between the stretching roll and the cloth as a result of the movement of the mobile frame in response to variations of the width of the cloth as detected by sensitive means, the interaction of the stretching roll with the pair of idler bars being capable of cancelling any undulation in the cloth and maintaining the edge of the cloth perfectly straight and well aligned with the feed path.

4 Claims, 4 Drawing Figures

ROLLING-UP MACHINE FOR LENGTHS OF CLOTH DESTINED FOR COLLAR-CUTTING MACHINES

The present invention relates to a machine for the rolling up of lengths of cloth intended to being cut by another machine and thus form rolls of collars (straight-lined thread strips of cloth rolls).

Rolling-up machines of known type substantially comprise a rolling-up bar, one or more cloth pulling cylinders connected to the standard machine driving motor, a bar carrying the cloth to be rolled up and one or more stretching bars placed between the cloth carrying bar and the rolling-up roller.

In general, in the known machines, the cloth carrying bars and the stretching bars are assembled on a mobile frame designed to move crosswise in the direction of the unrolling motion of the cloth.

In general, because the ball of cloth leaving the mill has not a constant width, this frame translation motion is necessary to compensate for existing difference in width and to obtain in this manner, at least at one side, a constant heading of the roll prepared for cutting the collars.

This is necessary for reducing to a minimum the waste of material when making the collars which, as known, are obtained by cutting the cloth roll perpendicularly into strips of a pre-established width.

The heading of the rolls was visually adjusted by an operator displacing the mobile frame manually each time he observed a departure between one of the two lateral edges of the cloth and a fixed reference point.

In addition, on the known machines, the cloth is rolled up on a bar pulling it forward by means of a roll covered with a material having a high friction coefficient, against which the cloth is pressed by a pressure roll.

The particular function of the roll covered with high-friction coefficient material is that to draw the cloth off the suitably clutched cloth carrying bar and push it toward the rolling-up bar.

Because of the fact that the pressure roll is pressing the cloth against the material having a high-friction coefficient covering the cloth-drawing bar, possible undulations not completely straightened out by the stretching bars, pass between the contacting rolls owing to the fact that no allowance was made for a certain sliding effect between cloth and cloth-drawing roll.

The possible presence of undulations in the rolled up cloth caused a deviation from the straight-thread laying of the roll of cloth with respect to the feed path of the cloth toward the rolling-up bar.

The main object of the present invention is the elimination of the above-mentioned drawbacks and, more precisely, to render the heading operation fully automatic as well as ensuring the cancelling out of any undulation or ply in the cloth before the rolling-up step.

The above object is reached by a rolling-up machine of the above-mentioned kind comprising a cloth stretching roll spaced away from and parallel to the cloth-drawing roll, both rolls rotating in the same direction; comprising still further a pair of idler bars below the stretching roll and assembled onto the mobile frame, the idler bars pressing one against the other so as to stretch the cloth passing between them and ensure a certain sliding effect in cross-wise direction between the stretching roll and the cloth caused by the motion of the mobile frame in reply to variations of the profile of the cloth detected by sensitive means; the combination of the stretching roll with the pair of idler bars being also suitable for cancelling any possible undulation in the cloth and maintain the straight thread well-aligned with the direction of feed.

These and other objects of this invention will become more evident from the following description given by way of example without being limited thereto and on hand of the following drawings in which.

Figure 1:
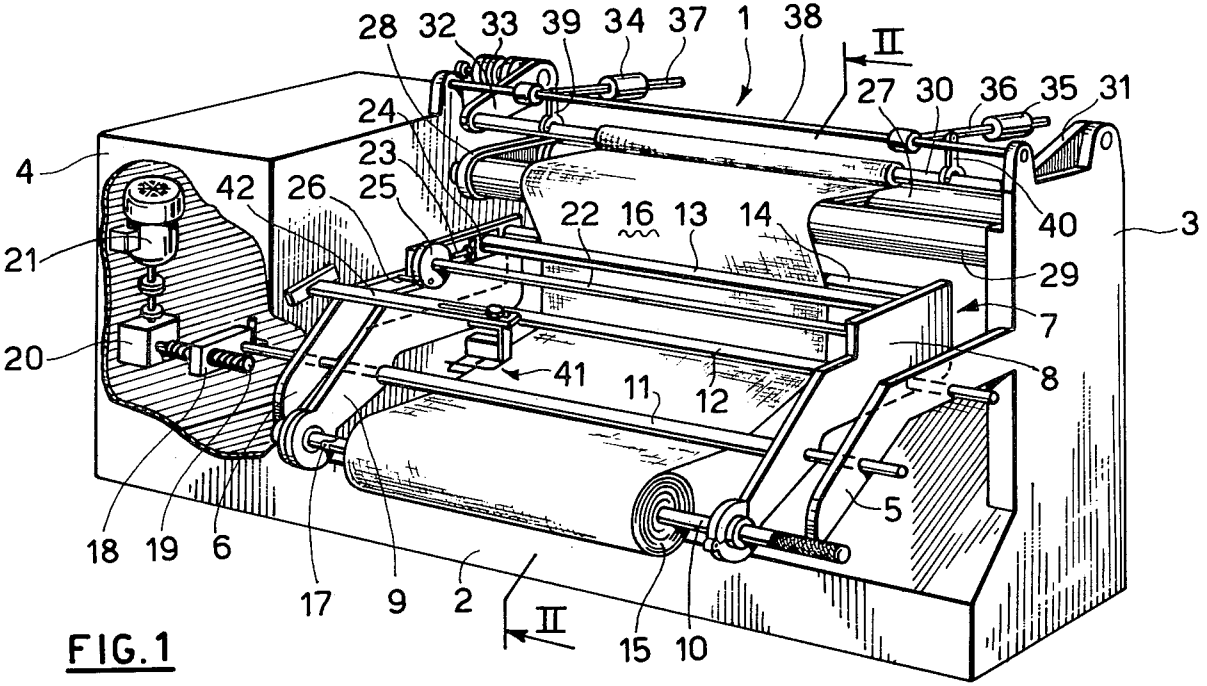
FIG. 1 is an elevation, in perspective, of a rolling-up machine of this invention.
Figure 2:
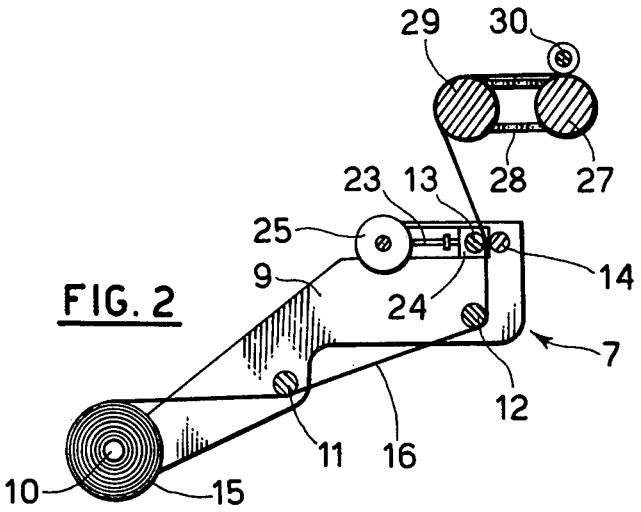
FIG. 2 is a cross-section through the machine of FIG. 1 seen along the line II—II.

Referring now to FIG. 1, the rolling-up machine according to the present invention comprises a frame 1 consisting of a bed 2 on which are resting two lateral uprights 3 and 4, each being fitted with a bracket 5 and 6, respectively, as supports for a mobile frame 7.

The frame 7 consists of two parallel plates 8 and 9 carrying therebetween a cloth-carrying bar 10, two fixed stretching bars 11 and 12 and a pair of idler bars 13 and 14.

The cloth-carrying bar 10 is clutch-coupled to the outer side of plate 9 and supported, releasable, by the outer side of plate 8.

In addition, this bar 10 has an articulated joint 17 near plate 9 allowing it to be turned over for inserting a new roll 15 of cloth 16, the cloth 16 being at first stretched by the stretching bars 11 and 12 and then drawn tight by the bars 13 and 14.

Both the fixed stretching bars 11 and 12 are longer than the mobile frame 7 and are inserted into and project beyond the brackets 5 and 6, supporting in this manner the mobile frame 7 and allowing it to move transversally in direction of the rolling-up movement of cloth 16.

The movement of the frame 7 is controlled by the stretching bar 11 connected for this purpose with a block 18 coupled to a worm screw 19 driven by a speed reducer controlled by a motor 21, with the possibility to rotate in both directions and seated inside of the lateral upright 4.

The idler bars 13 and 14 are positioned on the mobile frame 7 at the end opposite of that carrying the cloth-carrying bar 10 and are arranged in the same horizontal plane.

The idler bar 13 can be displaced with respect to the idler bar 14 to allow the easy introduction of the cloth 16 and to allow them to adapt themselves to the thickness of the cloth.

The displacement of the bar 13 can be obtained by means consisting of a transverse shaft 22 having its fulcrum on the mobile frame 7, with not-shown means on both its ends, onto which a connection rod 23 is eccentrically pivoted complete with sliding supports 24 carrying the ends of the idler bar 13.

A disk 25 with stop 26 is fitted integrally to the transverse shaft 22 allowing it to be rotated whenever necessary.

The rotation of the disk 25 rotates also the means which are integral parts of the transverse shaft 22 with a corresponding movement of the rods 23 which, thus, move the idler bar 13 away from the idler bar 14 while keeping it parallel to the latter.

On the upper part of the uprights 3 and 4 is mounted in fixed position a power-driven cloth drawing roll 27 complete with the normal driving means (not shown) positioned in the upright 4.

The cloth-drawing roll 27 is covered with material having a high friction coefficient, for example, a layer of rubber, and is kinematically connected by a chain 28 with a stretching roll 29 having a perfectly smooth outer surface allowing the relative and trans verse sliding of the cloth passing over this roll.

Both these rolls are arranged in a plane which is substantially parallel to the plane comprising the axes of the two idler bars 13 and 14.

Adherent to the cloth-drawing roll, on top thereof, we have a rolling-up bar 30 for the tight-rolling up of the cloth 16 arriving from the mobile frame 7.

The rolling up bar is mounted onto two oscillating arms 31 and 32 freely seated on the uprights 3 and 4.

The arm 32 is hollow inside to allow the housing of the driving means required for the rolling-up bar and comprising a clutch 33 allowing a sliding motion between the motor shaft (not shown) of the machine driving means and the rolling-up bar 30. This sliding effect is necessary to reduce the rotation speed of the rolling-up bar 30 with the progressive increase in diameter of the cloth roll forming thereon.

The rolling-up bar 30 is elastically pressed against the underlying cloth-drawing roll 27 and cooperates with the same in keeping the cloth roll compact, the elastic pressure effect being obtained by two weights 34 and 35 adjustably mounted respectively on oscillating arms 37 and 36, around a fixed bar 38 and provided respectively with a rod 39 and a rod 40 pressed with the free end onto the rolling-up bar 30 by means of rolling the elements attached to said rods. The rods 39 and 40 are positioned at the side of the ends of the cloth roll.

To control the profile of the cloth 16 unrolling from the roll 15 and to maintain it in line with the part of the cloth rolled up on the bar 30, sensitive means 41 are provided supported by an appositely positioned support 42 forming an integral part of the upright 4.

Figure 3:
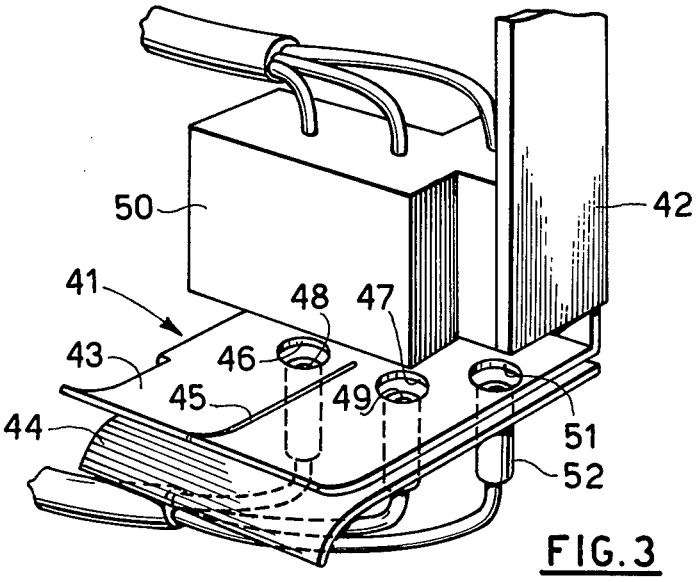
FIG. 3 shows, in perspective, the sensitive means for reading the profile of the edge of cloth to be rolled up.

As shown in FIG. 3, the sensitive means 41 comprise two plates 43 and 44 spaced apart one above the other with the cloth 16 sliding therebetween.

The upper plate 43 is provided with a reference line 45 flanked at both sides with circular holes 46 and 47, one on each side allowing the passing of a light beam emitted by lamps 48 and 49 respectively of two photodiodes (not shown in FIG. 3) part of the sensitive detecting means and contained in a box 50 over the top plate 43.

The photodiodes are provided to detect any displacement of the cloth profile from the reference line 45.

At the side of the Lamp 48 directed toward the inner part of the mobile frame 7 we find a further circular hole 51 and a lamp 52 of a photoelectric cell for detecting the end of the roll 15 and automatically stopping in a known manner the machine.

Once the photoelectric cell has interrupted the feed motion ensured by the standard driving means of the machine, the rolling-up of the cloth onto the rolling-up bar is completed by means of a common manual control not shown.

Figure 4:
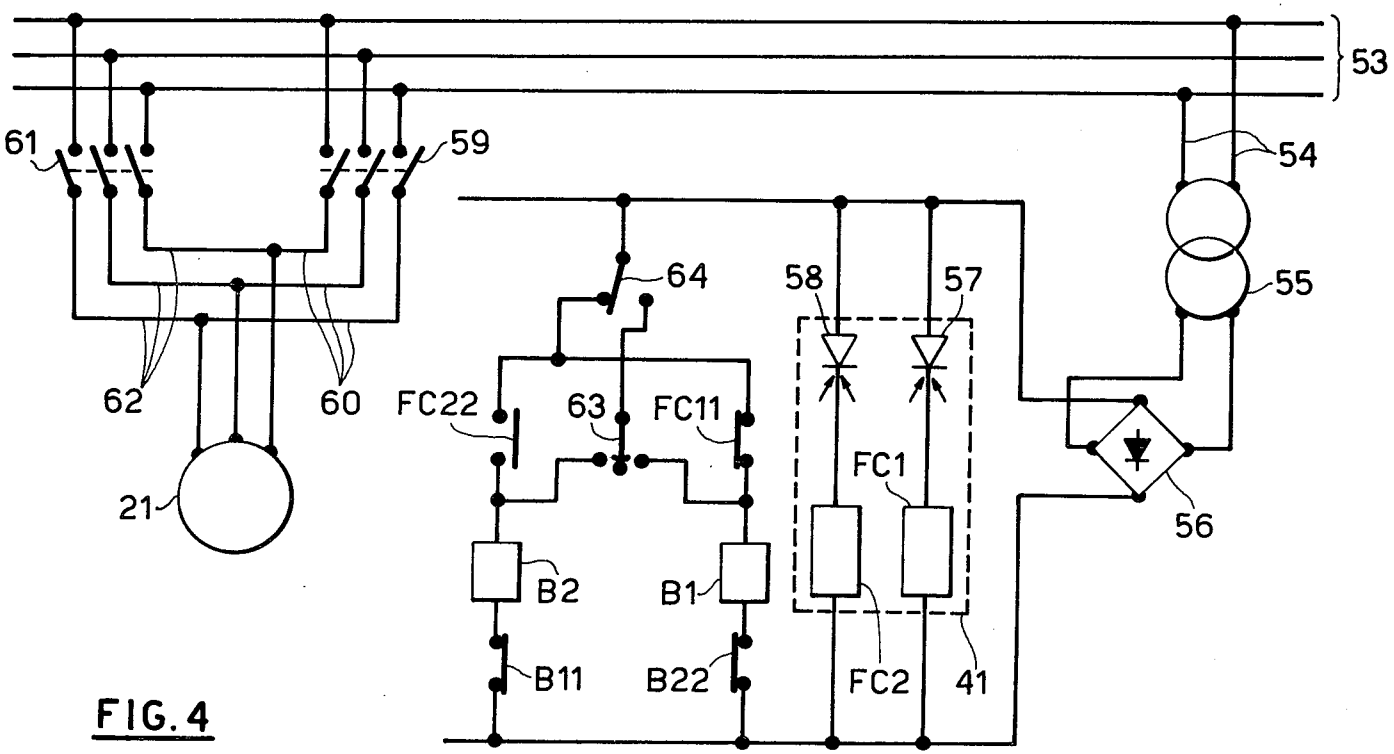
FIG. 4 is the part wiring diagram of the electric control circuit of the rolling-up machine of this inventon.

Referring now to FIG. 4, the rolling-up machine of this invention has the already mentioned sensitive detection means 41 inserted into an apposite electrical supply circuit of the auxiliary motor 21.

More precisely, the electric circuit comprises a three-phase input line 53, from a single-phase line 54 leading to a transformer 55 supplying a rectifier (current) 56.

The latter, in turn, supplies two photodiodes 57 and 58 influenced respectively by the already mentioned lamps 48 and 49 and connected to the respective amplifiers FC1 and FC2.

The photo-diode 57 normally is blacked out by the edge of the cloth passing between the plates 43 and 44, while the photo-diode 58 is normally illuminated because the said edge of the cloth when perfectly straight, is in line with the reference line 45 between the two photo-diodes 57 and 58.

When the edge of the cloth surpasses the reference line 45, that is, when there is an irregular increase in width of the cloth, also the second photo-diode 58 will be blacked out and thus cause the de-energising of its amplifier FC2, resulting in the closing of the contact FC22 in the energising circuit of a coil B2 of a teleswitch 59 inserted into the input line 60 of the auxiliary motor 21.

This, in turn, results in a rotation of the auxiliary motor 21 in a direction which causes the mobile frame 7 to move to the right until the edge of the cloth is again aligned with the reference line 45.

As soon as this position has been reached the photo-diode 58 is again illuminated, the coil B2 becomes de-energised because of the opening of the contact FC22 and immediately interrupts the input to the auxiliary motor 21.

On the other hand, if there should be a reduction in the width of the cloth, with the edge thereof moving away from the reference line 45, the lamp 49 will now illuminate the photo-diode 57 and cause the energising of the amplifier FC1 with the resulting closing of the contact FC11 in the emergising circuit of coil B1 of a teleswitch 61 provided in the input line 62 of the auxiliary motor.

The phases of the input line 62 are reversed with respect to those of input line 60, so that the motor will now rotate in opposite direction and continue to do so, until the movement of the mobile frame 7 returns the edge of the cloth to the reference line 45 and result in the blacking out of the photo-diode 57.

To prevent the contemporaneous energising of both photo-diodes 57 and 58 by accidental causes, safety contacts B11 and B22 are inserted into the energising circuits of the coils B1 and B2.

More precisely, contact B22 is inserted into the circuit of the coil B1 and will be opened each time when coil B2 is energised, viceversa, contact B11 is inserted into the circuit of coil B2 and is opened each time the coil B1 is energised.

Both energising circuits, that of coil B1 and that of coil B2, can be supplied alternatively by means of a manual control 63, electrically connected to a commutator 64, which is manually operated to exclude the sensitive means, comprising the photo-diodes 57 and 58.

Any displacement of the mobile frame 7 in either direction causes the cloth 16 passing between the idler bars 13 and 14, to tend and deviate with respect to the stretching roll 29 thereover which, having a perfectly smooth surface, allows the cloth to take up any desired position.

What we claim is:

1. A rolling-up machine for lengths of cloth destined for collar-cutting machines, comprising a rolling-up bar, means to drive said bar, a cloth-drawing roll, means to drive said roll, a mobile frame carrying fixed stretching bars and a bar carrying the cloth to be rolled up, the said mobile frame being able to move transversally to the direction of unrolling of the cloth and continuously align the profile of one of the edges of the cloth roll corresponding to the head of the roll formed on the rolling-up bar, a cloth-stretching roll spaced from and parallel to the said cloth-drawing roll and rotating in the same direction; a pair of idler bars seated below the said stretching roll on the said mobile frame; these idler rolls being pressed one against the other so as to press the cloth passing therethrough and cause a relative transverse sliding motion between the stretching roll and the cloth as a result of the movement of the mobile frame in response to variations of the width of the cloth as detected by sensitive means, the interaction of the stretching roll with the pair of idler bars being capable of cancelling any undulation in the cloth and maintaining the edge of the cloth perfectly straight and well aligned with the feed path.

2. A rolling-up machine for lengths of cloth according to claim 1, in which one of the idler bars can be displaced with respect to the other one by means of sliding supports connected by rods to eccentric means which are an integral part of a transverse shaft provided with driving means capable to cause the mobile idler bar to move away from or up to the fixed idler bar, the ends of the mobile idler bar being seated on the sliding supports.

3. A rolling-up machine for lengths of cloth according to claim 1, in which the sensitive detecting means comprise two photo-diodes with corresponding lamps arranged one on each side of a reference line, along which one of the edges of the cloth is running, the photo-diodes being provided for detecting any displacement of the cloth edge from the reference line and for controlling the transverse movements of the mobile frame to compensate for the displacement.

4. A rolling-up machine for lengths of cloth according to claim 3, in wich the photo-diodes are provided to energise suitable coils of teleswitches inserted respectively into the two input leads of an auxiliary driving motor controlling the displacement of the mobile frame; the said auxiliary motor being connected to the mobile frame by means of a worm screw engaging a block forming an integral part of a bar fixed to the said mobile frame.

* * * * *